US005222997A

United States Patent [19]

Montgomery

[11] Patent Number: 5,222,997

[45] Date of Patent: Jun. 29, 1993

[54] PARALLEL HOLDER DEVICE

[76] Inventor: David S. Montgomery, 6305 Tennyson St., Arvada, Colo. 80003

[21] Appl. No.: 918,065

[22] Filed: Jul. 24, 1992

[51] Int. Cl.[5] ..... B25B 1/00

[52] U.S. Cl. ..... 269/277

[58] Field of Search ..... 294/93, 86.24, 86.28, 294/86.32, 100, 99.1; 269/277, 275, 157, 254 CS

[56] References Cited

U.S. PATENT DOCUMENTS

| | | | |
|---|---|---|---|
| 1,336,087 | 4/1920 | O'Shaughnessy | 269/157 |
| 1,651,263 | 11/1927 | Fetters | 269/157 |
| 1,672,808 | 6/1928 | Hansel | 269/277 |
| 1,827,258 | 10/1931 | Poyzant | 269/157 |
| 2,123,131 | 7/1938 | Zugermayer | 269/157 |
| 2,818,095 | 12/1957 | Stahl et al. | 269/254 CS |
| 2,838,971 | 6/1958 | Shekter | 269/277 |
| 3,245,677 | 4/1966 | Hurd et al. | 269/254 CS |
| 3,891,201 | 6/1975 | Clugage . | |
| 4,558,856 | 12/1985 | Shaffer . | |
| 4,852,866 | 8/1989 | Kristoff | 269/277 |

*Primary Examiner*—Robert C. Watson

*Attorney, Agent, or Firm*—Fields, Lewis, Pittenger & Rost

[57] ABSTRACT

A holder device for selectively positioning and retaining a pair of parallels at a selected position against the opposed jaws of a vise found on a milling machine, drill press or the like. The holder device includes stationary and movable retaining members in the form of flat plates and a guide arrangement for maintaining the retaining members parallel during movement between extended and retracted positions. The guide arrangement includes two parallel spaced inner tubes attached at adjacent ends to the stationary retaining member and extending perpendicular to the length of the inner tubes together with a pair of parallel spaced outer tubes attached at adjacent ends of the second retaining member and perpendicular thereto. The outer tubes telescope over the inner tubes to provide parallel positioning for the retaining members. A force applying or bias is provided in each of the inner tubes causing the two retaining members to move to a separated extended position of maximum spacing. When an inward force is applied against the retaining member in the direction of the tube length, the retaining plate moves to a closer position so that when between a pair of vise jaws the retaining members resiliently urge a pair of parallels against the vise jaws.

9 Claims, 1 Drawing Sheet

PARALLEL HOLDER DEVICE

TECHNICAL FIELD

This invention relates generally to holder devices and more particularly to holder devices for positioning and retaining parallels against the jaws of a vise.

BACKGROUND ART

A vise is commonly used to secure workpieces to be machined. In order to secure such workpieces within the vise, a pair of thin, flat plates known as parallels may be used. Parallels commonly consist of metal plates of varying length and width dimensions and thicknesses. The parallels are mounted between the vise jaws and the workpiece. Parallels serve to mount the workpiece in an exact location and may serve as a guide for a machining operation. Shaffer U.S. Pat. No. 4,558,856 discloses a holder for retaining a pair of parallels against the jaws of a vise. Shaffer's device makes use of a U-shaped spring body that pivotally attaches to a pair of end members which engage the parallels. Another device as found in Clugage U.S. Pat. No. 3,891,201 reveals a method for securing workpieces by means of a hold down element; however, no resilient holding mechanism is disclosed.

DISCLOSURE OF THE INVENTION

The holder device disclosed has stationary and movable retaining members and a parallel guide for the retaining members which includes a pair of hollow, parallel spaced inner tubes attached at adjacent ends to the stationary retaining member and extending perpendicular to the length of the inner tubes. The movable retaining member is similar in shape to that of the stationary retaining member. Two parallel spaced outer tubes are attached at their adjacent ends to the movable retaining member and these tubes are in a plane perpendicular to the movable retaining member. The two parallel outer tubes fit over the inner tubes in a telescopic fashion so that the retaining members are maintained parallel to one another during movement between different spacing positions for the retaining members. A force applying arrangement includes a helical spring disposed inside each inner tube and the spring is rigidly attached to the inner tube on one end and to the associated outer tube on the other end. When the two retaining members are pressed together by a force, the outer tubes slidably move along the inner tubes. As the two retaining members move together, the bias force of the springs provides an opposite acting resistive force. This resistive force created by the displacement of the retaining member provides for the requisite force to secure parallels against the jaws of a vise.

BRIEF DESCRIPTION OF THE DRAWINGS

Details of this invention are described in connection with the accompanying drawings which like parts bear similar reference numerals in which.

DETAILED DESCRIPTION

Figure 1:
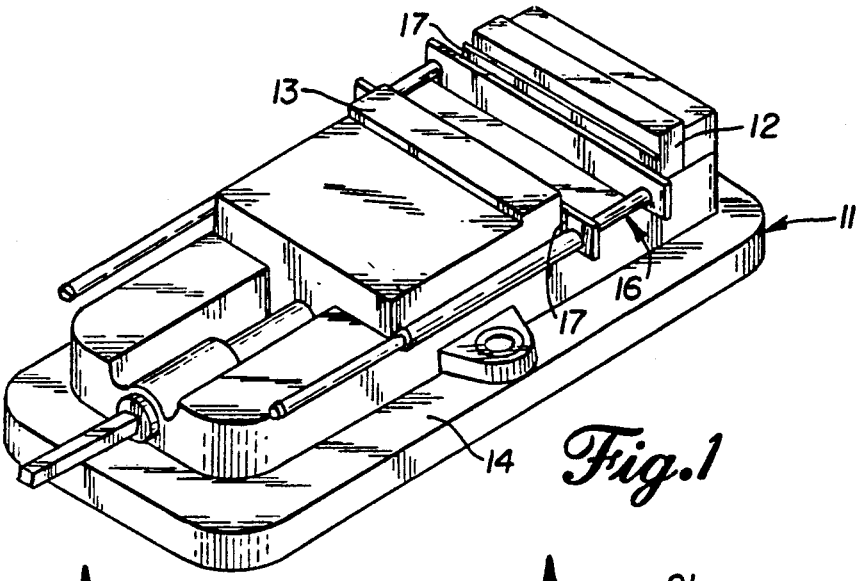
FIG. 1 is a perspective view of a vise with a holder device embodying features of the present invention installed providing separation and retention for a pair of parallels.
Figure 2:
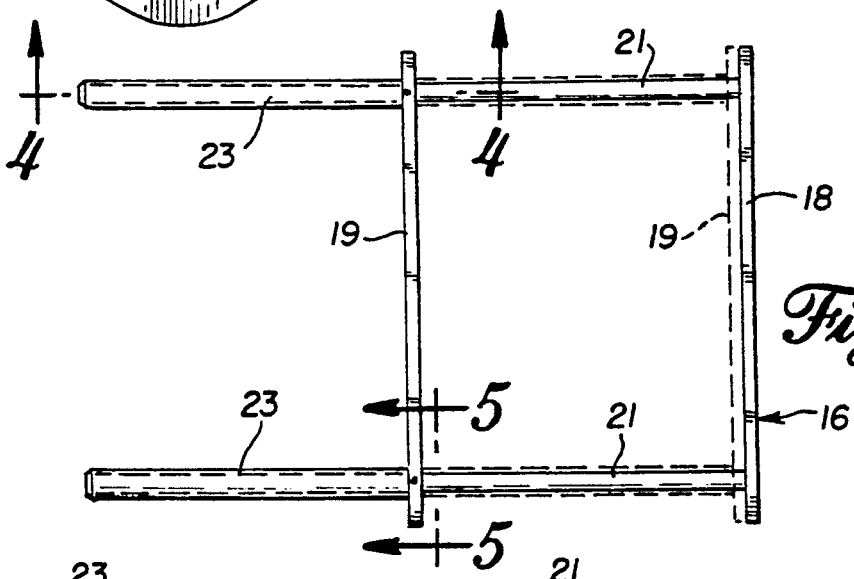
FIG. 2 is a top plan view of the holder device with the retaining member shown in a fully extended position and a fully retracted position shown in dashed lines.
Figure 3:
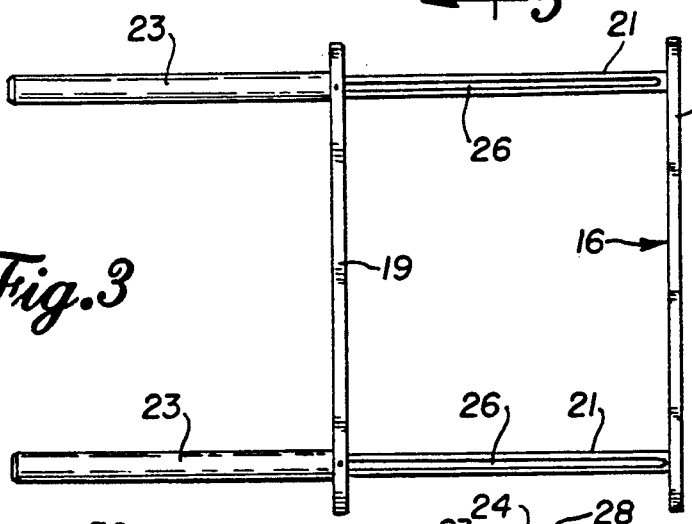
FIG. 3 is a bottom plan view of the holder device showing the bottom slots in the inner tube.
Figure 5:
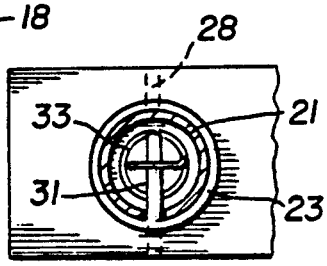
FIG. 5 is a sectional view taken along line 5—5 of FIG. 2.
Figure 4:
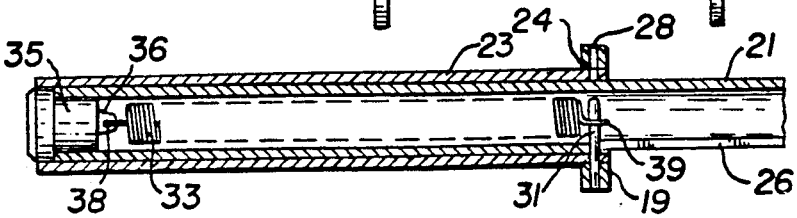
FIG. 4 is a sectional view taken along line 4—4 of FIG. 2.

Referring now to the drawing, FIG. 1 shows a vise 11 common to machines such as drill presses, milling machines and the like having a stationary vise jaw 12 and a movable vise jaw 13 supported on a base 14. A holder device 16 embodying features of the present invention is shown installed in an operative position on the vise between the vise jaws 12 and 13. A pair of parallels 17 are shown held by the holder device 16 against the vise jaws 12 and 13.

The holder device 16 shown includes a stationary retaining member 18 and a movable retaining member 19. The retaining members 18 and 19 are made of a rectangular piece of metal or plastic with flat surfaces including opposed work engaging surfaces which accommodate a flush mounting against the parallels 17.

A guide arrangement maintains the retaining members 18 and 19 parallel to one another during movement of the movable retaining member which as shown includes a pair of parallel spaced inner tubes 21 attached at adjacent ends to the retaining member 18. The specific attachment shown includes a hole in the retaining member 18 through which the inner tubes extend and are held in a forced or friction fitting relationship. Similarly, the pair of outer tubes 23 attach at their adjacent ends to the movable retaining member 19. Again the outer tubes extend through holes 24 in the end portions of the movable retaining member 19 and are held in a force or friction fitting relationship. The outer tubes 23 being of larger diameter than the inner tubes telescope over the inner tubes and position the retaining members parallel to one another at all times. The open ends of the outer tubes that pass through the movable retaining member 19 has holes 24 that allow the inner tubes 21 to pass through the movable retaining member and into the associated outer tubes in a telescopic manner. Each inner tube 21 has an elongated slot 26 cut out along a portion of the length thereof. A pin 31 extends upwardly through a hole in the bottom of the movable retaining member 19 and into the interior radius of the inner tube and bears against the end of the slot 26 to hold the movable retaining member 19 and connected outer tubes 23 in the extended position. A hole 28 is shown in the top of the retaining member in alignment with the pin to facilitate drilling out the pin in the event of spring failure or the like.

A force applying arrangement resiliently urges the movable retaining member 19 to an at-rest extended position of maximum spacing between the retaining members. The force applying means utilized is a coil or helical spring 33 inside each inner tube 21. A plug 35 caps the end of each inner tube 21 and the plug has an eyelet 36 protruding out along an inner side of the plug. A curved end portion 38 of the spring passes through the eyelet 36 which serves to attach the spring to one end of the inner tube. The spring is attached to the outer tube retaining member 19 by having a curved end portion 39 hooking over a transverse pin 31 attached to the movable retaining member 19 and outer tube 23.

As shown, the retaining members are normally in the extended position of maximum spacing. During the use and operation of the parallel holder device 16 the retaining members 18 and 19 are brought closer together and placed between the jaws of the vise. The jaws of the vise which are a distance less than the maximum spacing between the retaining members press inwardly against the faces of the retaining members and the springs 33 inside the inner tubes 21 stretch which creates a resistive force pushing outward against the vise jaws through a range of spacing positions for the vise jaws. The parallels 17 placed between the jaws and the retaining members will be separated and held in place in order that a workpiece may be machined.

The present invention provides a simple and inexpensive tool to separate and maintain parallels used in machining operations. The sliding action of the movable retaining member allows compatibility with virtually all parallels conforming to the inside dimension between the jaws of a vise. The springs retained in the inner tubes provide a steady and reliable counter force in which the parallels can be held in place. Moreover, the retainer device requires no tools for installation, can be easily and safely manipulated by hand.

Although the present invention has been described with a certain degree of particularity, it is understood that the present disclosure has been made by way of example and that changes in details of structure may be made without departing from the spirit thereof.

What is claimed is:

1. A holder device for selectively positioning and retaining a pair of parallels against a pair of vise jaws comprising:

first and second retaining member, said retaining members being in the form of substantially flat plates having a pair of opposed substantially flat work engaging surfaces facing away from each other, guide means for maintaining said retaining members parallel to one another during movement between a first position wherein said retaining members are a maximum spacing and a second position wherein said retaining members are at minimum spacing, force applying means for resiliently urging said retaining members to said first position and resisting movement toward said second position, whereby when said first and second retaining members are disposed between a pair of vise jaws disposed apart a distance less tan said maximum spacing distance said work engaging surfaces resiliently urge a pair of parallels against said vise jaws through a range of spacing positions for said vise jaws.

2. A holder device as set forth in claim 1 wherein said guide means includes a pair of parallel spaced inner tubes secured at adjacent ends to said first retaining member and a pair of parallel spaced outer tubes secured at adjacent ends to said second retaining members, said outer tubes slidably telescoping over said inner tubes with said inner tubes passing through holes in end portions of said retaining member and open end portions of said outer tubes.

3. A holder device as set forth in claim 2 wherein said force applying means includes a helical spring disposed inside each of said inner tubes and opposite said first retaining member.

4. A holder device as set forth in claim 3, each said spring being attached at one end to an associate inner tube and in which said spring is attached at its other end to an associated end of said outer tubes.

5. A holder device as set forth in claim 4 wherein said spring is attached to said outer tube by means of a curved end portion hooking over a pin rigidly connected to an end portion of said outer tube, said pin extending axially inward from an outside edge of said outer tube.

6. A holder device as set forth in claim 5 wherein said spring is attached to said inner tube by means of a curved end portion passing through an eyelet of a plug, said plug being rigidly attached to end of said inner tube.

7. A holder device for selectively positioning and retaining a pair of parallels against a pair of vise jaws comprising:

stationary and movable retaining members, guide means for maintaining said retaining members parallel to one another during movement between an extended position wherein said retaining members are at maximum spacing and a retracted position wherein said retaining members are at minimum spacing, said guide means including a pair of parallel spaced inner tubes secured at adjacent ends to said stationary retaining member and a pair of parallel spaced outer tubes secured at adjacent ends to said movable retaining members, said outer tubes slidably telescoping over said inner tubes with said inner tubes passing through holes in end portions, of said movable retaining member, and open ends of said outer tubes, force applying means for resiliently urging said retaining members to said extended position and resisting movement toward said retracted position, said force applying means including a coil spring disposed inside each of said inner tubes and arranged to elongate when said retaining members are moved toward one another to produce forces tending to spread said retaining members apart, whereby when said retaining members are disposed between a pair of vise jaws disposed apart a distance less than said maximum spacing distance said retaining members resiliently urge a pair of parallels against said vise jaws through a range of spacing positions for said vise jaws.

8. A holder device for selectively positioning and retaining a pair of parallels against a pair of vise jaws comprising:

first and second retaining members, guide means or maintaining said retaining members parallel to one another during movement between a first position wherein said retaining members are at maximum spacing and a second position wherein said retaining members are at minimum spacing, said guide means including a pair of parallel spaced inner tubes secured at adjacent ends to said first retaining member and a pair of parallel spaced outer tubes secured at adjacent ends to said second retaining members, said outer tubes slidably telescoping over said inner tubes with said inner tubes passing through holes in end portions of said second retaining member and open end portions of id outer tubes, each said inner tube having an elongated slot cut out along the longitudinal axis thereof, said slot extending along said inner tube, force applying means for resiliently urging said retaining members to said first position and resisting movement toward said second position, said force applying means including a helical spring disposed inside each of said inner tubes and opposite said first retaining member, each said spring being attached at one end to an associated end of said inner tue and in which said spring is attached at its other end to an associated end of said outer tubes, each said spring being attached to said outer tube by means of a curved end potion hooking over a pin rigidly connected to an end portion of said outer tube, said pin extending axially inward from an outside edge of said outer tube, whereby when said first and second retaining members are disposed between a pair of vise jaws disposed apart a distance less than said maximum spacing distance said retaining members resiliently huge a pair of parallels against said vise jaws through a range of spacing positions for said vise jaws.

9. A holder device as set forth in claim 8 wherein one end of said slot forms a stop for the movement of said outer tube and second retaining member to hold said second retaining members in said first position.

* * * * *